United States Patent [19]

White et al.

[11] 4,396,379

[45] Aug. 2, 1983

[54] THERMOPLASTIC BAG STACKING APPARATUS

[75] Inventors: Daniel A. White, Winnetka, Ill.; Dale W. Davis; Robert C. Faison, both of Green Bay, Wis.

[73] Assignee: FMC Corporation, Chicago, Ill.

[21] Appl. No.: 197,423

[22] Filed: Oct. 16, 1980

[51] Int. Cl.[3] ..... B31B 1/16; B31B 1/96

[52] U.S. Cl. ..... 493/194; 493/204; 493/224

[58] Field of Search ..... 493/204, 203, 193-196, 493/210, 239, 224; 156/515, 510

[56] References Cited

U.S. PATENT DOCUMENTS

| | | | |
|---|---|---|---|
| Re. 27,523 | 11/1972 | Maccherone | 214/8 |
| 3,431,828 | 3/1969 | Crawford et al. | 493/204 |
| 3,580,142 | 5/1971 | Stock et al. | 493/204 X |
| 3,587,410 | 6/1971 | Dechanciaux | 493/204 X |
| 3,663,338 | 5/1972 | Wech | 156/515 |
| 3,748,973 | 7/1973 | Kuck | 53/198 X |
| 3,810,420 | 5/1974 | Ravel | 493/204 |
| 4,083,747 | 4/1978 | Rochla | 156/510 |

FOREIGN PATENT DOCUMENTS 1206295 12/1965 Fed. Rep. of Germany

*Primary Examiner*—James F. Coan

*Attorney, Agent, or Firm*—Louis J. Pizzanelli; Richard B. Megley

[57] ABSTRACT

Disclosed is a stacking device associated with a bag making machine for producing bags from thermoplastic material. The device includes a stacking station at which successive bags are accumulated in a registered pile. Creation and maintenance of a registered stack is achieved by sequentially operable clamping bars being operationally related such that at least one bar is always in contact with the bag stack as it is being accumulated. On completion of a stack, which is determined by a conventional machine cycle counter, a longitudinally travelling clamp arrangement moves the stack away from the stacking station. The disclosed device is particularly suitable to process high density polyethylene.

8 Claims, 20 Drawing Figures

74
86
42
90
108
34
44
184
46
92
S
190
54
105
206
176
50
106
252
208
222
228
240
230
234
198
238
238

74
86
42
90
108
34
44
184
46
92
S
190
54
105
206
176
50
106
252
208
228
240
234
230
238
198
238

106
74
90
86
108
34
44
184
46
92
S
190
54
105
206
42
252
208
228
240
234
230
238
238
198

THERMOPLASTIC BAG STACKING APPARATUS

FIELD OF THE INVENTION

This invention relates to equipment for converting thermoplastic films and more particularly to equipment for making and handling thermoplastic bags.

BACKGROUND OF THE INVENTION

Representative patented prior art relating to bag machines and bag machines incorporating devices for producing stacks of counted bags include U.S. Pat. Nos. 3,580,142 to Stock, Re. 27,523 to Maccherone and 3,663,338 to Wech, all of which are assigned to the assignee of the present application.

A variety of conditions resulting from the physical properties of thermoplastic web material hinder developing a stack of bags whose corresponding edges overlie each other to thereby create a stack much like a deck of cards. One condition whose magnitude depends upon the type of thermoplastic material is static. Converted web segments, by virtue of their manipulation by the machine elements themselves develop indiscriminate areas of positive and negative charges hindering proper stacking. The conventional approach to eliminating such static charges involves the utilization of high frequency AC static eliminator bars that create an AC field neutralizing the static charge on the web elements. Avoiding use of static eliminators is desirable as to initial cost and maintenance.

Thermoplastic web material of the type referred to as "low density polyethylene" (hereinafter sometimes referred to as LDP) has greater strength and is stiffer than low density polyethylene. Accordingly, low density polyethylene can be made much thinner with the result, however, it is much more difficult to stack bags or other web segments made therefrom. Moreover, low density polyethylene is very slippery therefor requiring firm control of a stack of bags during production, packing and dispensing at the retail level.

Stacking mechanisms associated with bag machines for producing side weld or bottom weld bags have been reasonably successful in those instances where the size of the bag is small. A small bag in the terms of reference used herein means a bag whose length and width are substantially equal and are from 30 to 50 square inches in area. Stacking was achieved by propelling the bag to a collection tray or an area defined by fences on a stacking table. Low density polyethylene produces stacks which are soft and fluffy due to trapped layers of air between the individual bags and therefore greatly decreasing stack density which, in some cases, limits the number of bags which can be accumulated in a stack. Stackers also include pins on which the bags are impaled in register. This approach is objectionable due to the holes created by the pins.

Prior art solving the problem of generating and maintaining a registered stack of bags regardless of the type of thermoplastic film being used or bag size is shown and described in U.S. Pat. No. 3,587,410 to Dechanciaux, U.S. Pat. No. 4,083,747 to Rochla and U.S. Pat. No. 3,748,973 to Kuck. The first mentioned patent discloses a clamping arrangement operative to clamp the web segment fed by the machine before it is cut and sealed and maintains a clamping pressure on the bag stack during the time when another web segment is fed. U.S. Pat. No. 4,083,747 provides a seal bar perforating arrangement for separating the web into segments defined by laterally spaced seals having a line of perforation therebetween. Bags are created by providing sequentially operable clamping mechanisms that separate web segments to define the individual bags and the bags are collected in a registered pile. U.S. Pat. No. 3,748,973 discloses collecting bags in gripping units being operable to transfer successive stacks from a cylinder to a table. German Pat. No. 1 206 295 discloses transfer of bag stacks on a stacking table.

SUMMARY OF THE INVENTION

According to the present invention, a stacking apparatus is provided in which constant control of the leading web portion is effected before the web is severed and sealed. Control is achieved by sequentially operable retaining means that continually compress the severed and sealed web segments defining a stack. The retaining means cooperate with intermittently operable web feeding means to tension the web, thereby rendering a hot knife effective to sever the leading web portion without causing tacking or sealing of the opposed web.

Further, according to the present invention, means are provided to transport a completed stack of bags from the stacking station and yet maintain stacking registration. Such means comprises a clamping bar cooperating with an elevatable segmented platen for clamping the completed stack. The clamped stack is transported away from the stacking station.

DESCRIPTION OF THE PREFERRED EMBODIMENT

Figure 1:
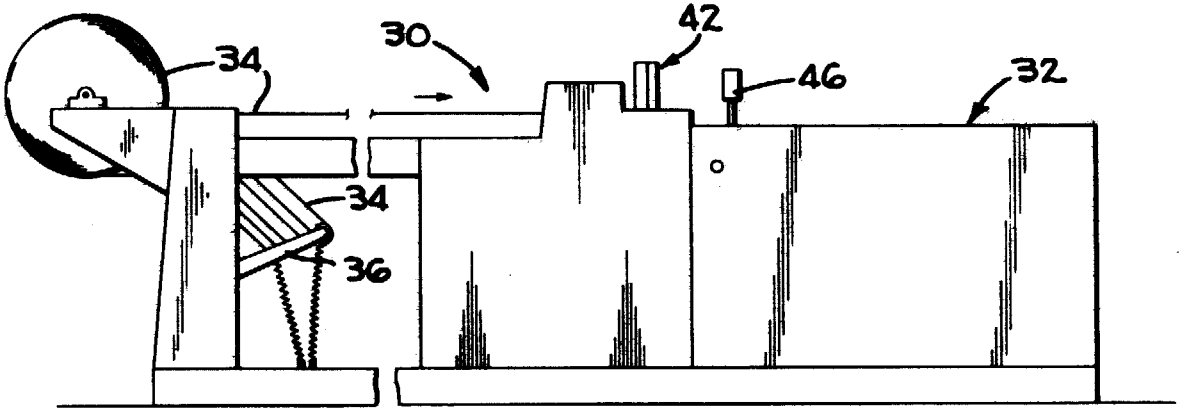
FIG. 1 is a side elevation of a conventional bag machine having the novel stacker incorporating the principles of the present invention associated therewith.

FIG. 1 illustrates a conventional bag machine 30 operatively associated with the novel stacking mechanism 32 incorporating the features and principles of the present invention. The bag machine supports a web roll of thermoplastic material 34 passing through a dancer assembly 36 as it is unwound by a pair of opposed upper and lower draw rolls 38 and 40, respectively, shown in FIG. 2. The draw rolls are operated to feed a predetermined segment of web which is severed and sealed by a seal bar structure 42. Severing and sealing of the advanced web segment produces a bag that is deposited at a stacking station S. Conventional machine controls determine the number of bags in a stack, which, on being completed, machine operation is interrupted electrically conditioning the controls to effect transfer of the completed stack to a remote location or advance it sufficiently so that a subsequently generated stack partially overlies the preceding stack.

Figures 2, 2A:
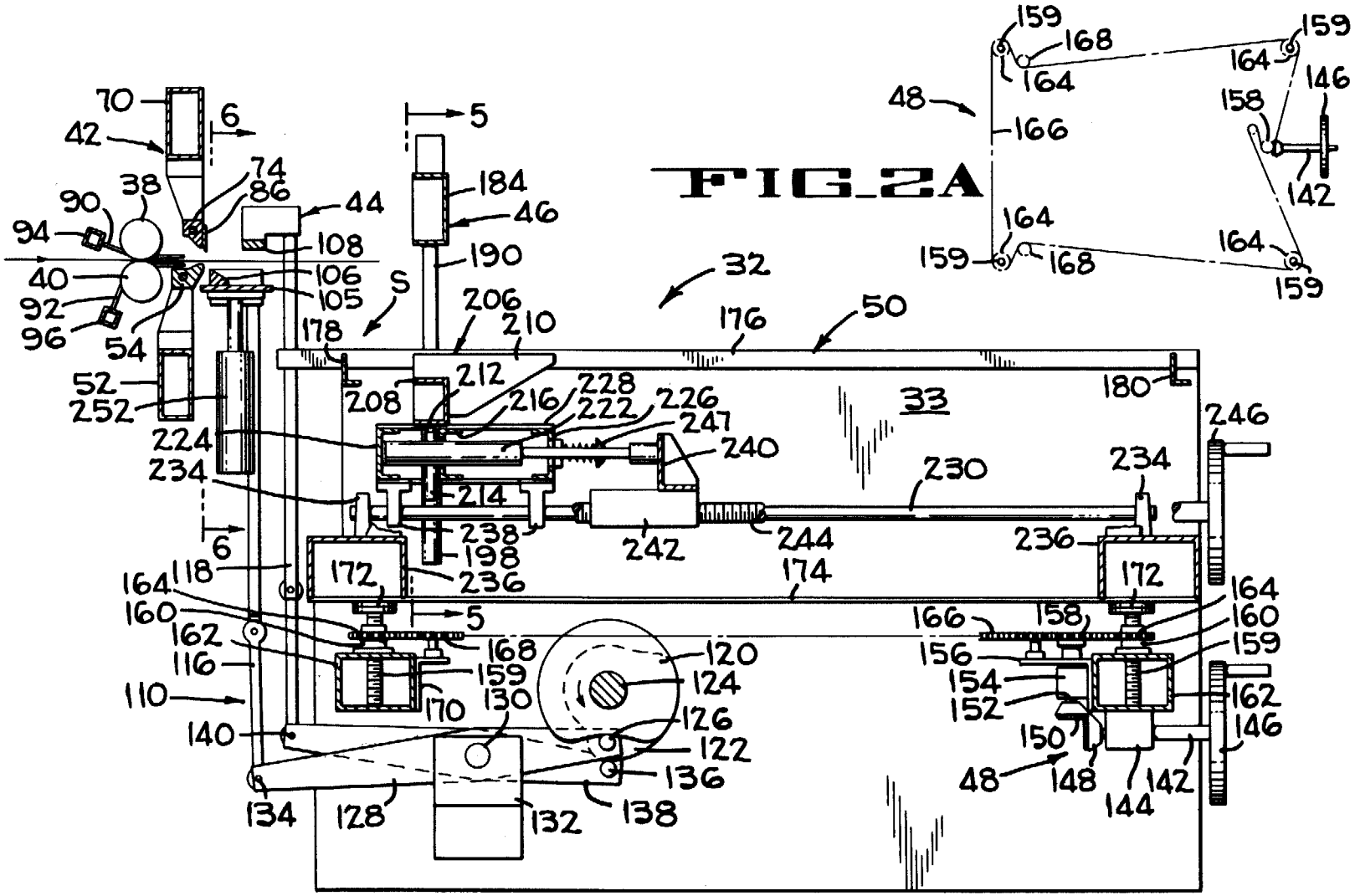
FIG. 2 is an enlarged longitudinal section of the stacking mechanism, FIG. 2A diagrammatically illustrates the raising lowering mechanism.

The novel stacking device 32, shown in greater detail in FIG. 2, comprises a synchronous alternatively operable bag and bag stack clamping means 44 and bag stack clamping and transporting means 46. The stacking device 32 also includes means 48 for raising and lowering the stacking table 50 as required by the thickness of the completed stack of bags.

Figure 3:
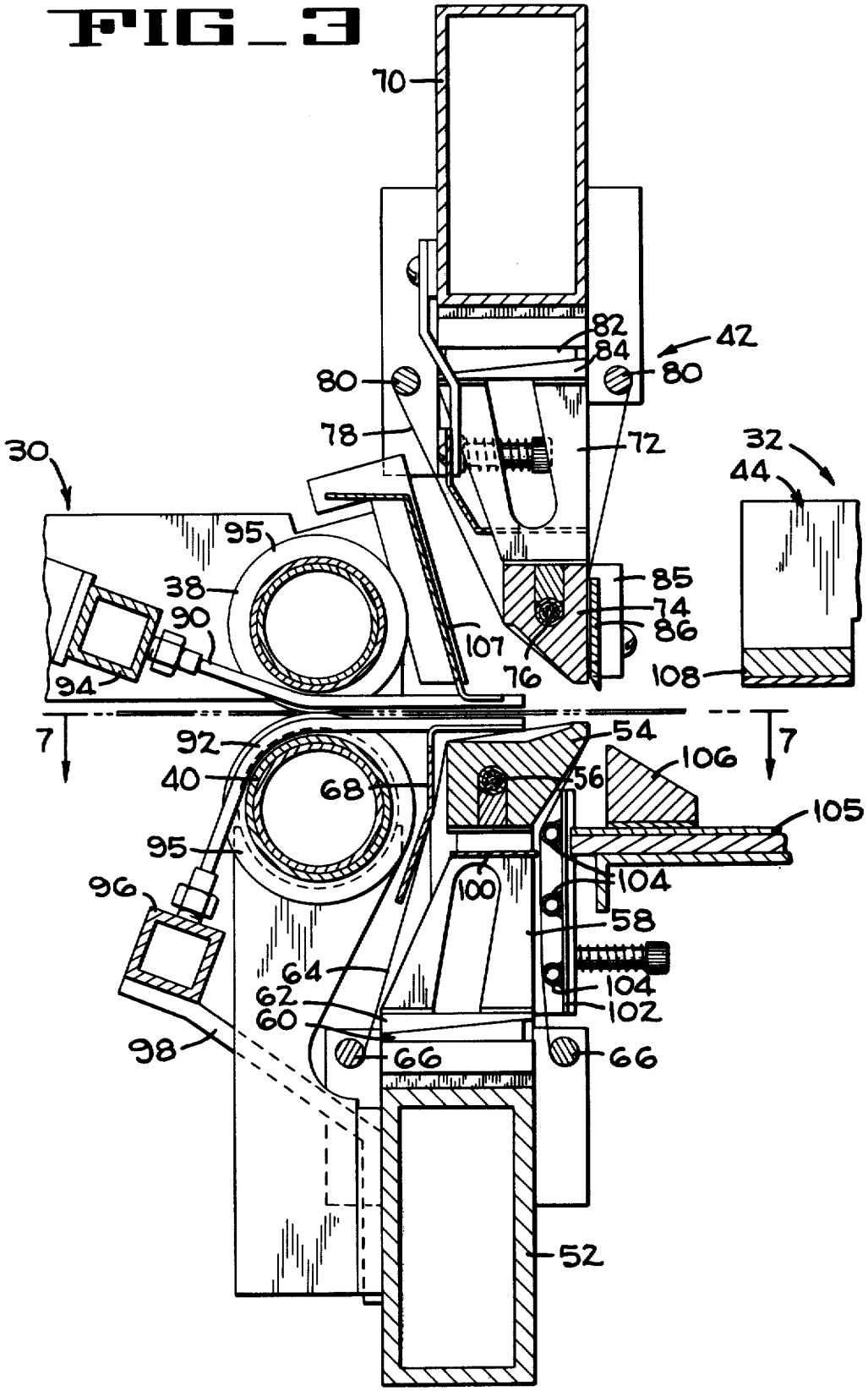
FIG. 3 is a greatly enlarged vertical section showing the relationship of the draw rolls, the seal bar and the air strippers.

Referring now to FIG. 3 illustrating the seal bar structure 42 in enlarged detail, it will be seen to comprise a transverse fixed beam 52 having its opposite ends rigidly secured to the side frames of the bag machine 30. A lower seal bar 54, heated to the desired temperature by the heating element 56, is rigidly connected to beam 52 by a plurality of regularly spaced thin plates 58 serving as extended surface radiators. To provide for seal bar linearity, a series of equally spaced adjustable wedges 60, cooperating with a fixed wedge 62, are provided. As is conventional in the art, the lower seal bar 54 is covered by a Teflon impregnated glass cloth 64 which may automatically be indexed, as its release qualities deteriorate, between rotatable shafts 66. The lower draw roll 40 is protected from the heat generated by the lower seal bar 54 by a heat shield 68.

The seal bar structure 42 includes an upper transversely extending reciprocable beam 70 to which is rigidly connected, by means of a plurality of evenly spaced plates 72, a seal bar 74, carrying a heating element 76. In like manner, a Teflon impregnated curtain 78 wound and unwound between rollers 80 shrouds the seal bar 74. To adjust the linearity of the seal bar 74, adjustable wedge 82 cooperating with the fixed wedge 84 is provided. The upper seal bar has mounted thereon, by means of clamps 85, a knife 86. The knife assumes the temperature of the seal bar 74 but, as will be explained hereinafter welding of the opposed panels of the web is prevented by tensioning the web portion between the draw rolls 38 and 40 and the bag and bag stack clamping means 44.

Figure 7:
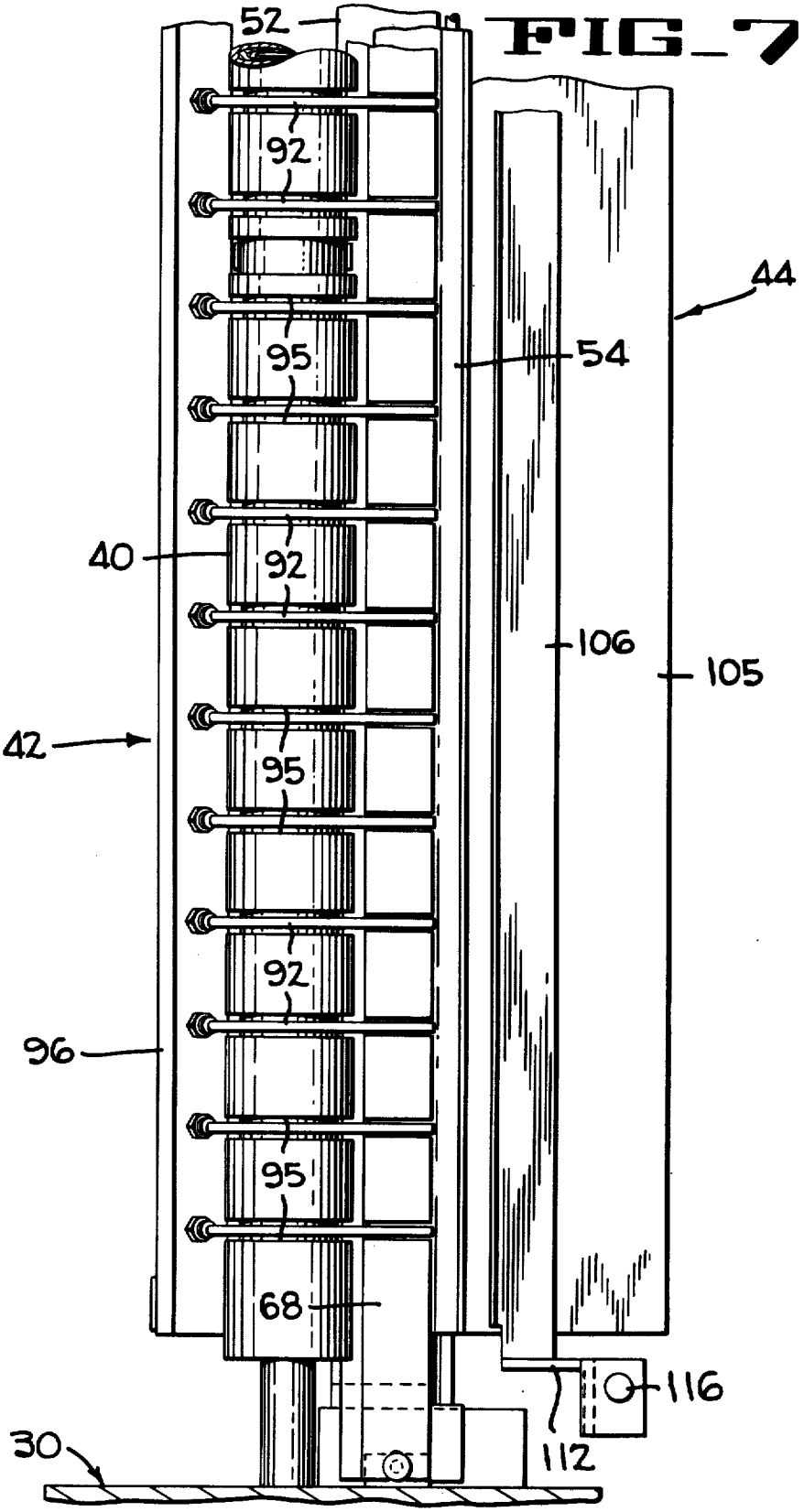
FIG. 7 is a plan of the lower seal bar as viewed in the plane 7—7 of FIG. 3, FIGS. 8 through 19 diagramatically illustrate certain components of the stacking mechanism to reveal the operational sequence followed in creating one or more bag stacks.

To insure that the portion of the web 34 advanced by the draw rolls 38 and 40 is maintained in a generally planar condition so that a smooth flat stack will be generated, a plurality of upper and lower air stripper fingers 90 and 92, respectively, are provided. To accommodate the linear portion of the air strippers and yet maintain a nip, the draw rolls 38 and 40 are formed with grooves 95 (FIG. 7) at equally longitudinally spaced intervals. As illustrated in FIG. 3, the upper fingers 90 are connected to an air manifold 94 while the lower stripper fingers 92 are connected to a manifold 96, supported by a bracket 98 fixed to the transverse beam 52. According to this construction, intermittent advancement of the web 34 by the draw rolls 38 and 40, inserts the web between the air strippers 90 and 92 operating, by virtue of the air issuing therefrom, to maintain the increment of advanced web generally planar although it is recognized that the web portion will assume a somewhat draped condition.

In addition to the heat shield 68, the lower seal bar 54 is provided with a transversely extending thin plate 100 shielding propagation of heat downwardly. Also, a heat shield 102, including conduits 104 conducting heat transfer fluid whether it be air or water, minimizes conduction of heat to a stack generating pad 105. Shields 107 protect the draw roll 38.

Figure 4:
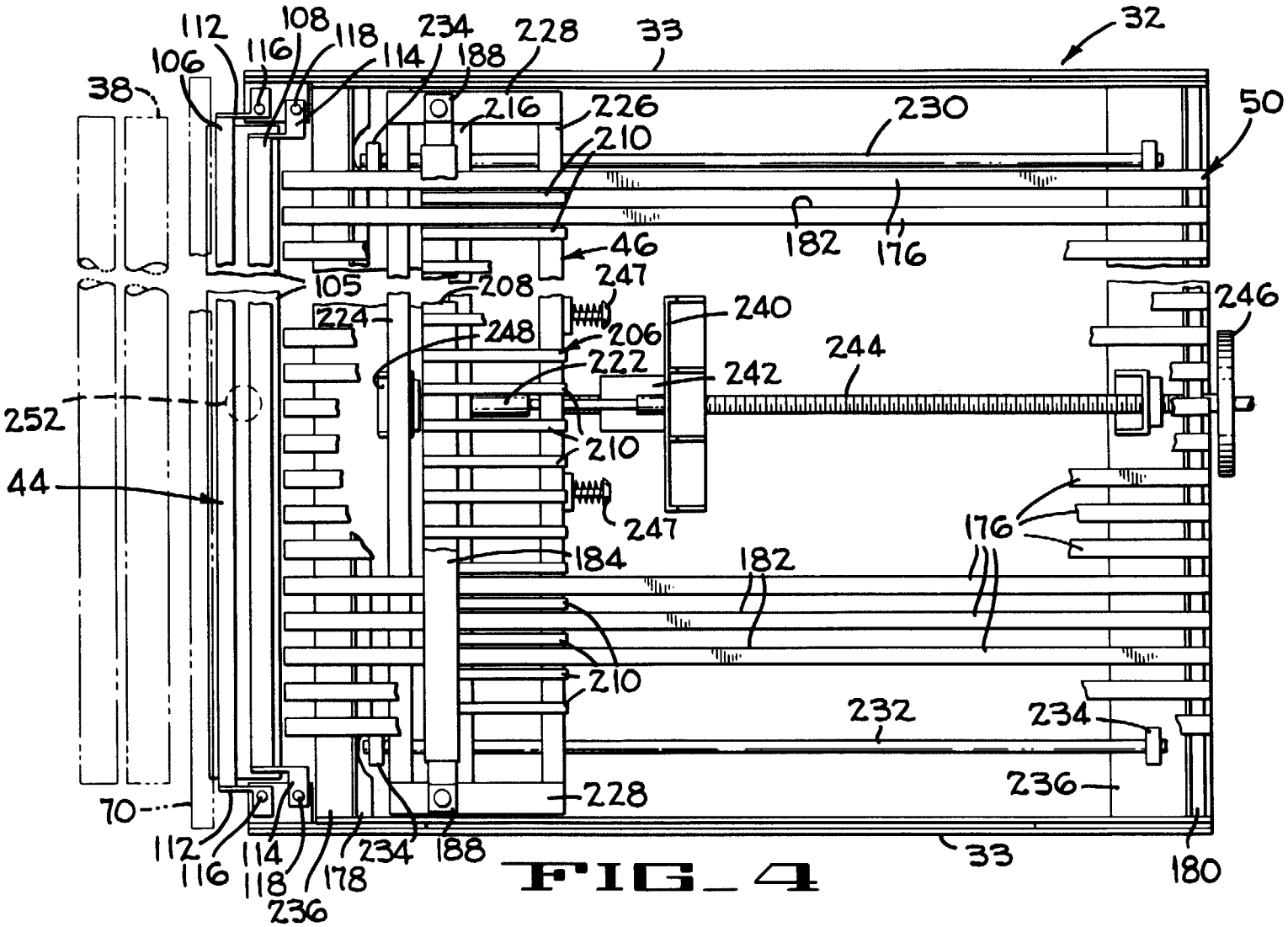
FIG. 4 is a plan with parts broken away of the stacking device.

In accordance with the present invention, the bag and bag stack clamping means 44 includes sequentially operable reciprocating clamping members cooperating with a fluid biased stacking post or platform that changes elevation in response to the height of a stack of bags being accumulated. The bag and bag stack clamping means 44 illustrated in FIGS. 2 and 4 comprises a first transversely extending clamping bar 106 and a second clamping bar 108. The clamping bars extend for substantially the entire width of the machine and each end of each bar is connected to a driving mechanism 110 effecting sequential vertical reciprocation of the bars. While FIG. 2 shows one of the driving mechanisms 110, it is to be understood that the identical arrangement is reproduced on either side of the longitudinal axis of the stacking mechanism 32. With reference to FIG. 4, it will be observed that clamping bar 106 has a bracket 112 secured to each end and clamping bar 108 has similar brackets 114 secured to each end. Each of the brackets 112 and 114 are connected to rods 116 and 118 (only two of which are shown in FIG. 2) driven by cams 120 and 122, respectively. The cams are keyed on a shaft 124 connected to the drive of the bag machine thereby synchronizing the action of the stacker with that of the bag machine. Cam 120 rollingly engages a cam follower roller 126 mounted on the end of a lever 128, pivoted on a rock shaft 130 carried by a fixed block 132. The other end of the lever 128 is pivotally connected to the rod 116 at 134. In like manner a cam follower roller 136 mounted at one end of a lever 138 mounted for pivotal movement on the rock shaft 130 and is pivotally connected at 140 to rod 118. By virtue of this construction, rotation of the shaft 124 effects, through the levers 128 and 138 and the rods 116 and 118, reciprocation of the clamps 106 and 108 toward and away from the pad 105.

The stacking table 50 is provided with the ability to assume an adjusted elevation by means of the raising and lowering means 48 to accommodate and develop bag stacks that may include a selected number of bags. As is apparent, a bag stack of 500 bags has appreciably larger height than a bag stack of 100 bags. Accordingly, the relationship of the upper surface of a stacking table 50 with respect to the plane of web feed and development is adjusted to accommodate bag stacks of desired height. The preferred construction of the table raising and lowering means 48 comprise a shaft 142 rotatably mounted in a bearing block 144 and having keyed on one end a hand operated wheel 146 and on the other end a bevel gear 148. The bevel gear 148 meshes with another bevel gear 150 fixed to a shaft 152. The shaft 152 is rotatably mounted in a block 154 and the block in turn is secured to an L shaped bracket 156. The shaft 152 carries a driving sprocket 158 which, as will be presently explained, drives height adjusting screws 159 located in the vicinity of each corner of the rectangular frame work (FIG. 2A). Each of the screws 159 are associated with a threaded collar 160 rotatably mounted in longitudinally spaced transversely extending box beams 162 having their ends fixed to the side frames 33 of the stacker 32. Each threaded collar 160 has secured thereon a sprocket 164 associated with a continuous sprocket chain 166. As shown in FIGS. 2 and 2A, idler sprockets 168, mounted on a bracket 170, are positioned to increase the arc of contact of the sprocket chain with the driving sprockets 164. The upper end of the screws 159 are received within thrust bearings 172 mounted on the underside of a generally rectangular platform 174.

According to the above-described construction, rotation of the hand wheel 146 and consequent rotation of the shaft 152 through the bevel gears 148, 150 imparts rotation to sprocket 158 which in turn, through the agency of the chain 166, effects rotation of the threaded flanges 160 which in turn, and depending on the direction of rotation of a hand wheel 146, causes upward or downward movement of the platform 174.

Figure 5:
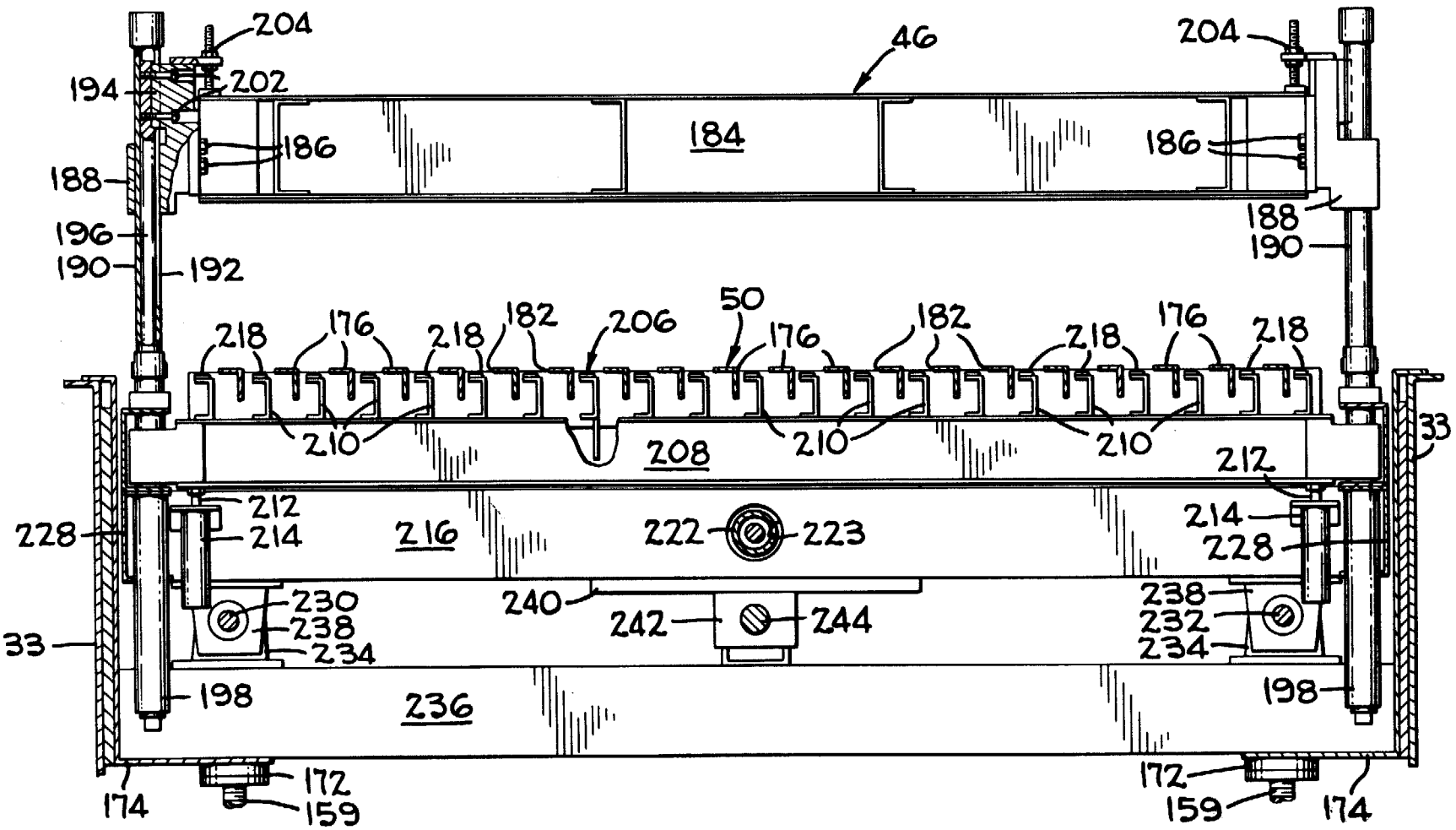
FIG. 5 is an enlarged section taken substantially along the line 5—5 of FIG. 2.
Figure 6:
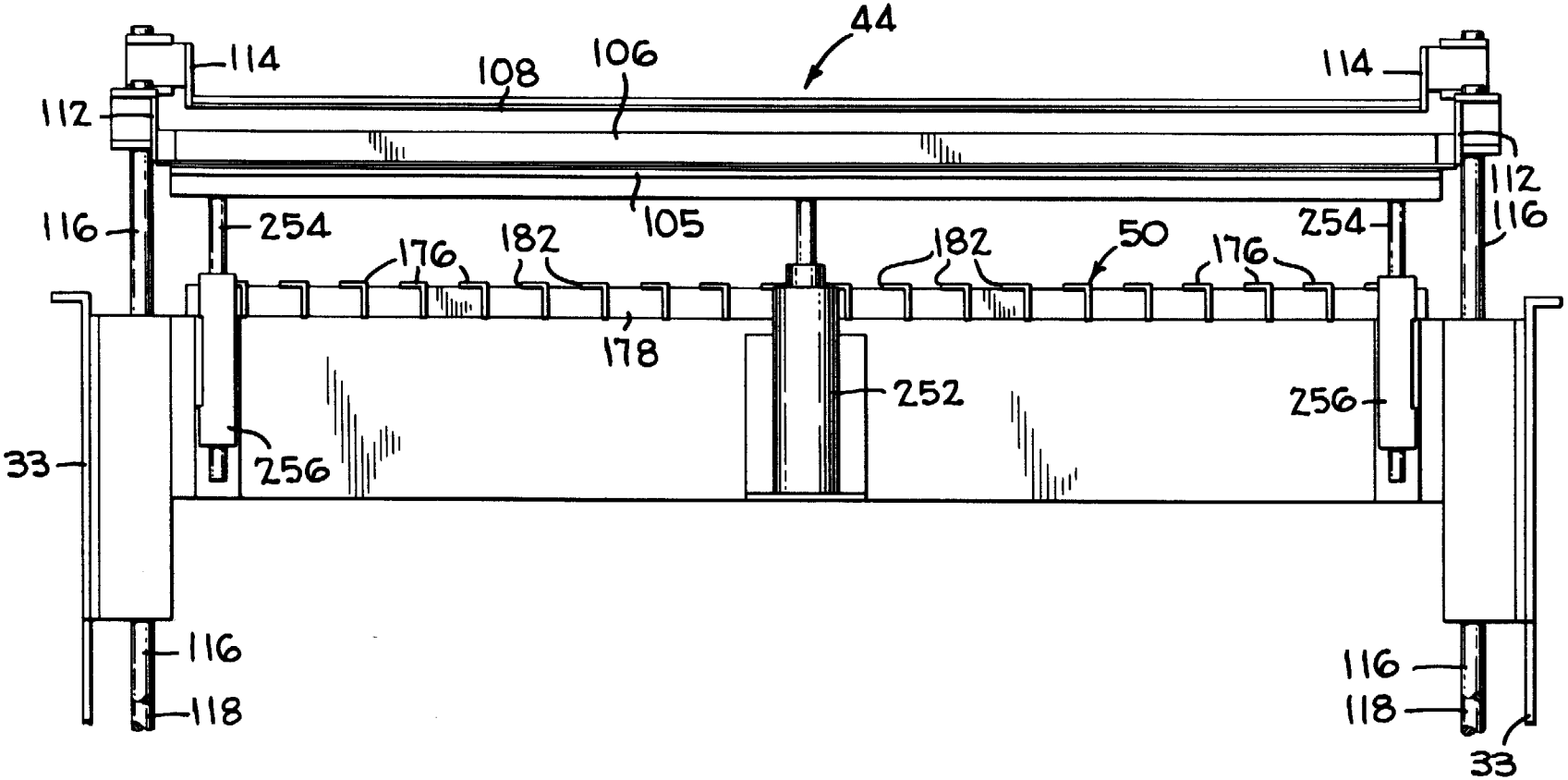
FIG. 6 is another section taken substantially along the line 6—6 of FIG. 2.

After a bag stack corresponding to the predetermined count has been accumulated on the stacking table 50, the bag stacking and transporting means is automatically actuated to index the completed stacks from left to right as viewed in FIG. 2. As shown in FIGS. 4 and 5, the surface of the stacking table 50 is defined by a plurality of longitudinally extending transversely spaced angle irons 176 connected to a cross beam 178 adjacent the bag and bag stacking means 44 and a cross beam 180 located at the opposite end of a stacker frame. By this construction it is apparent that the table 50 results in a construction providing a plurality of equally spaced longitudinal slots 182.

The bag stack clamping and transporting means 46 includes an overhead transversely extending clamping beam 184 having each end rigidly secured by means of fasteners 186 to blocks 188 being bored for slidable movement on upstanding posts 190. The posts 180 are formed with a longitudinal slot 192 in which rides a flat key portion 194 formed in each of the blocks 188. The key portion 194 is fastened to the upper end of a piston rod 196 of pistons 198. The extreme ends of the piston rods 196 are secured to the flat key portion 194 by fasteners 202. To adjust the beam 184 in parallelism with the surface of the table 50, screw adjustments 204 are provided.

To facilitate bag stack movement along the stacking table 50, a segmented elevatable platen 206 is provided. The platen comprises an elongate transversely extending support 208 having rigidly connected thereto a series of equally spaced plates 210 which, as shown in FIG. 4, are located within the slots 182. The beam 208 is attached at either end to the rod 212 of linear actuators 214 being rigidly connected to a transverse frame channel 216. A strip 218 of compressible material, such as rubber, is fixed to the upper surface of each plate 210. When a machine signal indicates the completion of a bag stack, the actuators 214 are extended, raising the lateral support 208 and of course the plates 210 attached thereto to assume an elevated position above the plane in which the angle irons 176 lie and concurrently the actuators 198 are energized to lower the beam 184 onto the bag stack and clamp the stack between the beam 184 and the elevated plates 210.

To transport the bag stack clamped between the plates 210 and the beam 184 a linear indexing mechanism is provided. The indexing mechanism comprises a linear actuator 222 attached to a transverse channel 224. The actuator 222 extends through a clearance hole 223 formed in beam 216 and a clearance hole formed in another transverse beam or channel 226. The ends of channels 216, 224 and 226 are joined to side channels 228. The box-like structure produced by the channels 228 and the channel irons 216, 224 and 226 is guided for longitudinal reciprocation effected by the linear actuator 222, by guide rods 230 and 232, each end of which is supported in blocks 234 which are in turn mounted on longitudinally spaced transversely extending platforms 236. Bored blocks 238 slidably received by the guide rods 230,232 are rigidly connected to the channel irons 224 and 226. The actuator 222 has its extending rod mounted to a gussetted angle bracket 240 and the angle bracket is in turn rigid with a block 242 having a tapped hole for threadedly receiving a lead screw 244. As shown in FIG. 2, the lead screw 244 has a hand wheel 246 keyed to its end while the other end is rotatably mounted in a bracket 248 connected to the platform 236.

Actuation of the actuator 222 whereby its rod is retracted causes movement of the linear indexing mechanism 220 away from the seal bar structure 42. A stack of bags clamped between the elevated platen 206 and the clamping beam 184 moves the bag stack in the aforementioned direction. The lead screw 244 functions to locate the top block 242, within limits, toward or away from the clamping beam 184 and its adjusted position is determined by the length of the bags being made and/or the degree to which successive stacks of bags are overlapped to assume a shingled array. Spring biased cushioning devices 247 make contact with the gusseted angle bracket 240 as indexing of the bag stack reaches its limit.

In addition to the pairs of linear actuators 198, 214 and actuator 222 respectively effecting bag stack clamping and linear bag stack transfer, the clamps 106 and 198 which are alternatively operable as described, cooperate with the laterally extending platform 105 supported by the rod of a linear actuator 252 and guided to maintain its parallelism by guide rods 254 slidably mounted in tubular housings 256 which may contain conventional bushings or ball bushings. The actuator 252 is associated with a pressure relief valve which maintains an upward bias to the platform 105 as a bag stack is being created. Accordingly, the platform 105 continually lowers and yet maintains adequate pressure between the alternately operating clamps 106 and 108.

Figure 8:
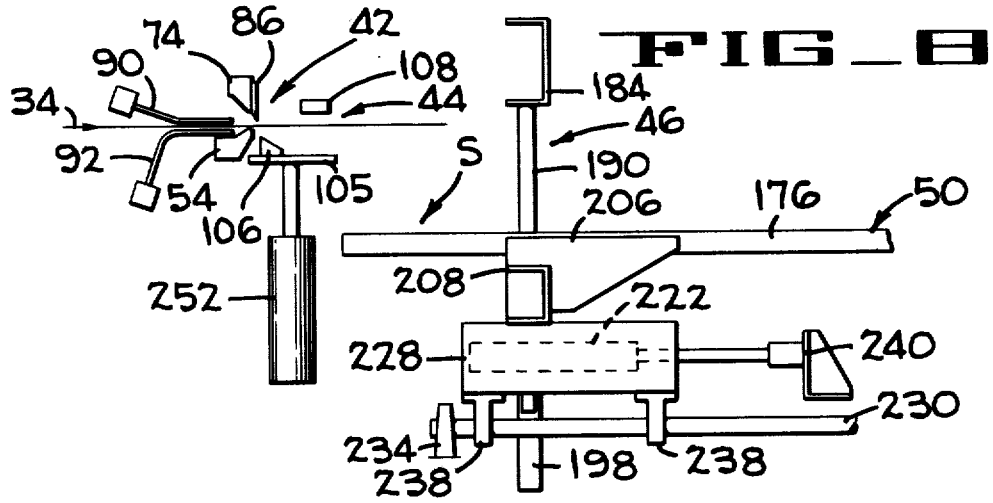
Figure 9:
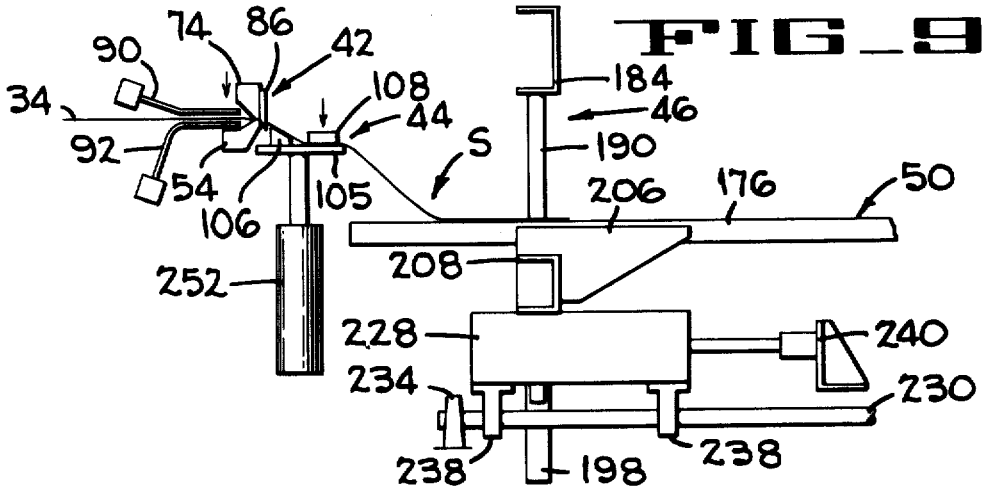
Figure 10:
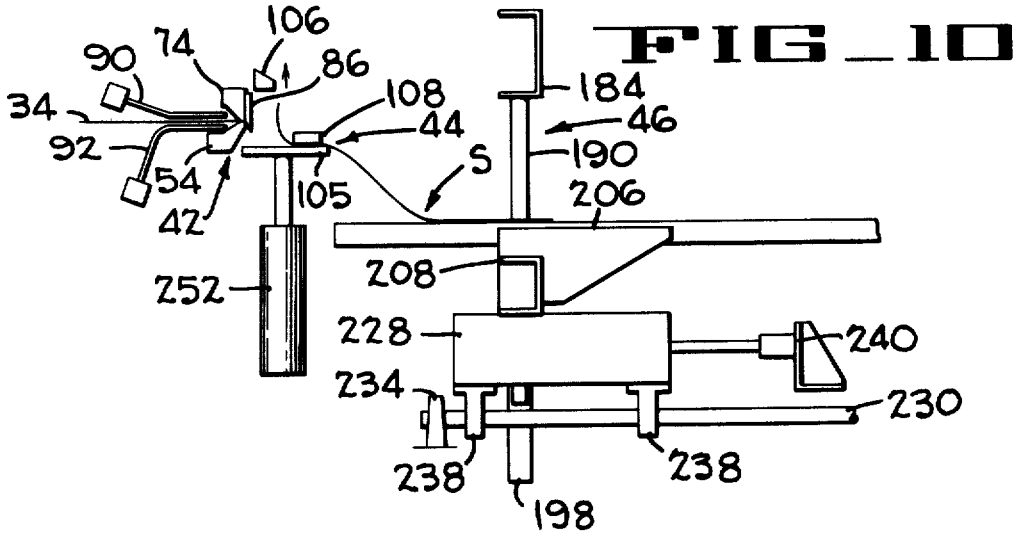
Figure 11:
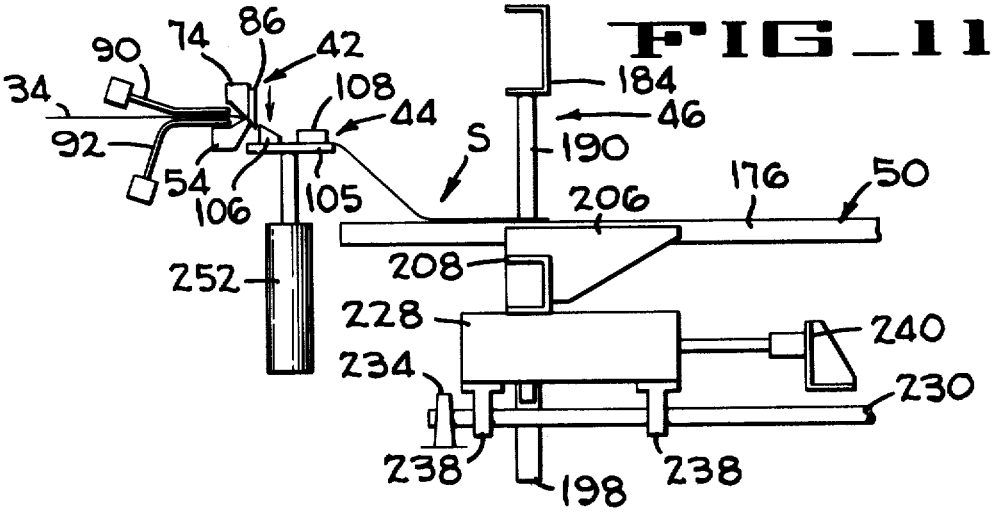
Figure 12:
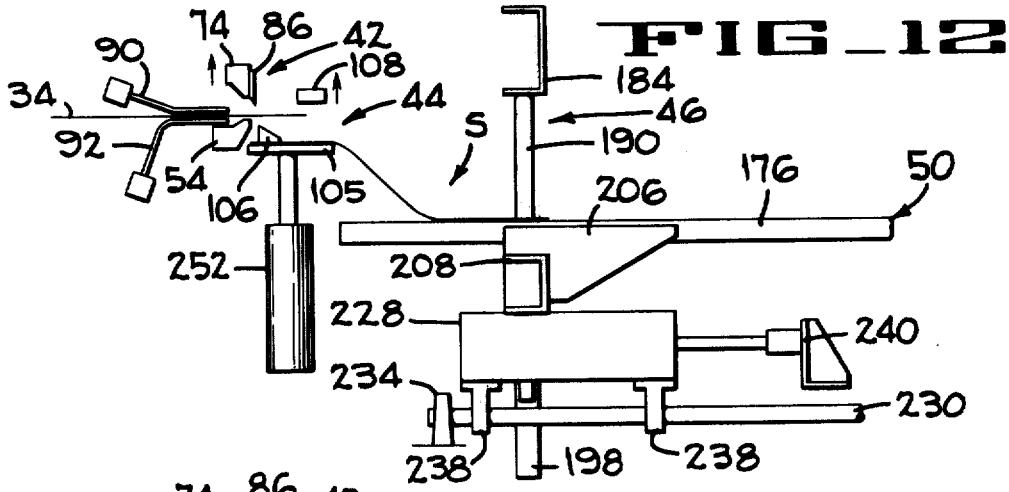
Figure 13:
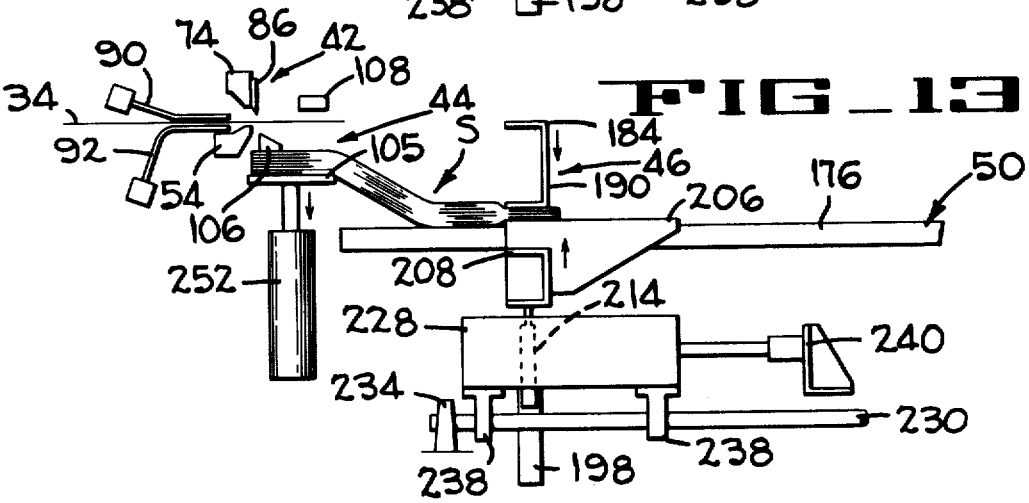
Figure 14:
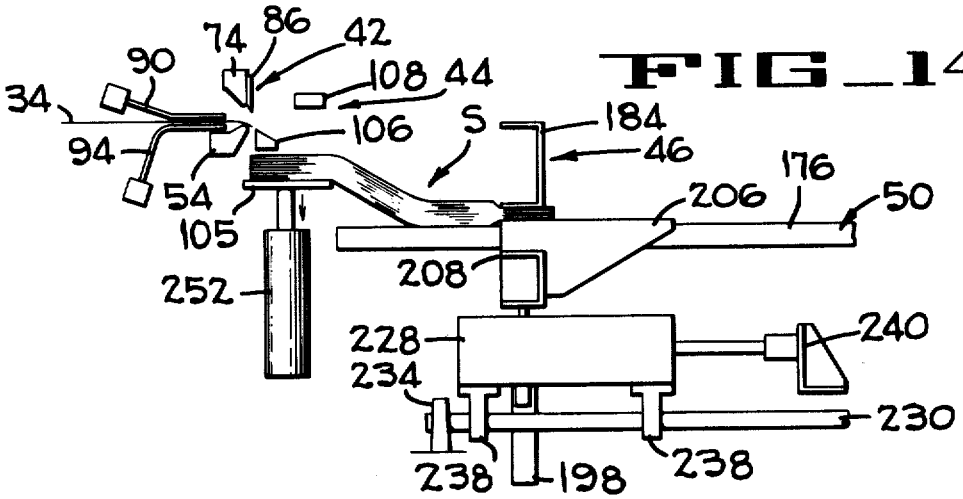
Figure 15:
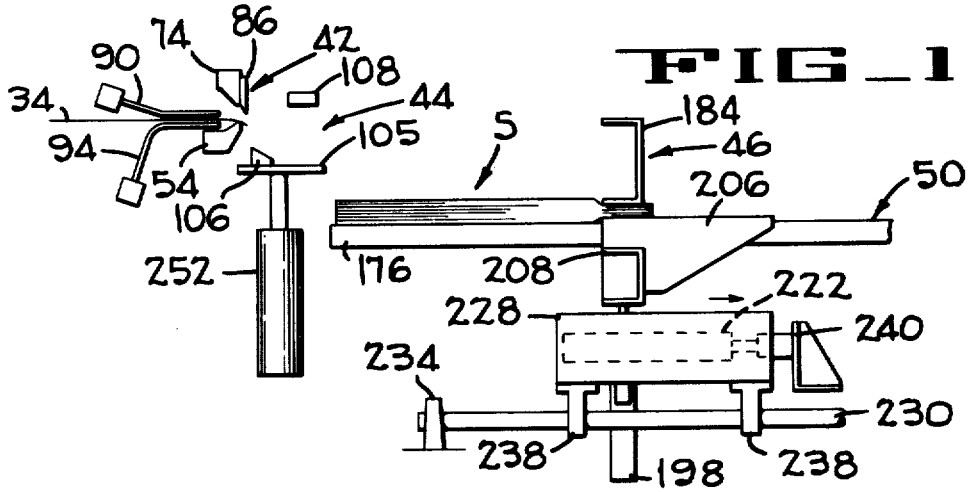
Figure 16:
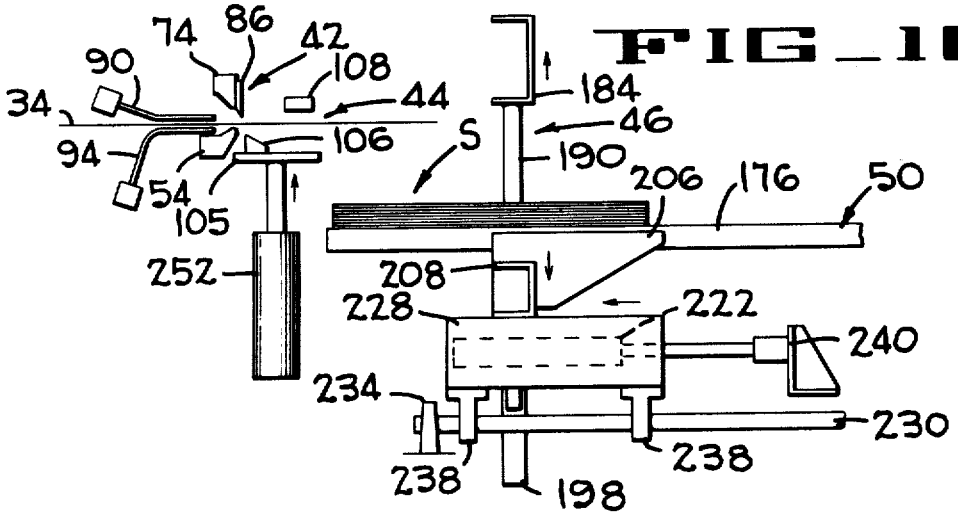

The overall mode of operation of the disclosed stacker will be described by reference to FIGS. 8 through 19 diagramatically illustrating bag development, stack creation and indexing of the first and subsequent stacks. With reference to FIG. 8, a selected amount of web, equal to the length of the bag, is projected beyond seal bars 74 and 54 and maintained substantially level by the high velocity air jets issuing through the air strippers 90 and 92. The position of the clamps 108 and 106 are illustrated in FIG. 9 with the advanced web portion firmly pressed against the platform 105 by the clamp 108. The web portion between the clamp 108 and the draw rolls 38 and 40 is firmly tensioned since the platform 105 is slightly depressed when clamping bar 108 comes in contact therewith. With the web tensioned, the upper seal bar 74 is driven downwardly whereupon the knife 86 transversely severs the projected web segment before the transverse zone of the web within the projected area of the sealing faces of the seal bars 54 and 74 come in contact therewith. Accordingly, before the web is sealed, the segment between the draw rolls and the sealing bars is completely relaxed and by tensioning of the web while it is being cut, sealing of the plys is prevented. After web severence (FIG. 10) the clamp 106 is raised while the clamp 108 maintains the bag in firm engagement with the platform 105. The portion of web strip between the clamping bars settles on the platform 105 as shown in FIG. 11. During this interval of time, the bottom seal for the next bag is formed and the clamping bar 106 returns in pressure engagement with the platform 105 while the clamping bar 108 maintains its position in contact with the platform. As shown in FIG. 12, the upper seal bar is returned to its raised position at about the same time that the clamping bar 108 is also raised. The bag machine initiates another bag making cycle by advancing another portion of web equal to the bag length desired. The process of feeding web segments past the seal bars and operating the clamps 106,108 to develop a bag stack (FIG. 13) continues until a predetermined count has been reached. The linear actuators 189 are then actuated lowering clamping beam 184 toward the table 50 while the actuators 214 are operated to raise the platen 206. With these operations occurring, as shown in FIG. 13, the completed bag stack is clamped. On being clamped, the actuator 252 lowers the platform 105 so that the clamping pressure of the clamps 106 is relieved, freeing the bag stack for translation along the stacking table 50 when the actuator 222 is operated to displace the bag and bag stack clamping and transferring means 46 from left to right, as viewed in FIG. 15. On completion of this operation the elements of the stacker 32 return to their original condition which is illustrated in FIG. 16.

Figure 17:
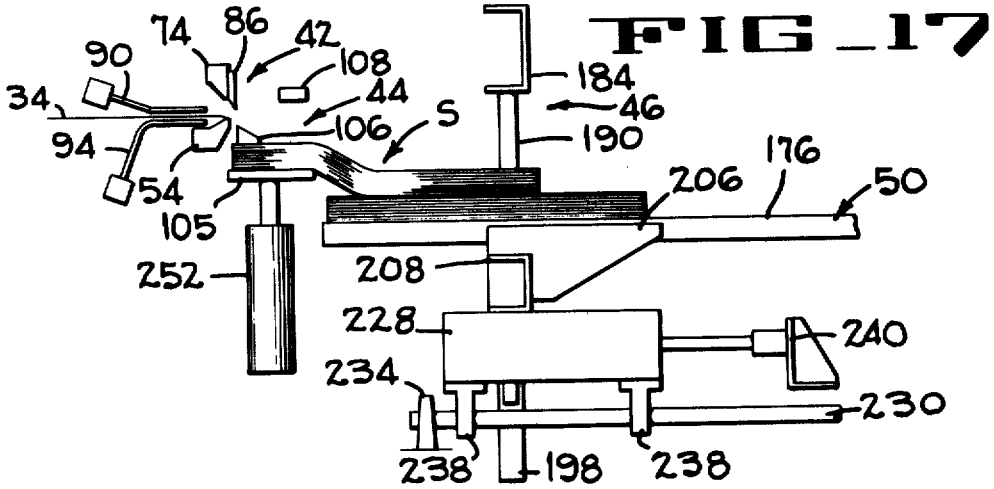
Figure 18:
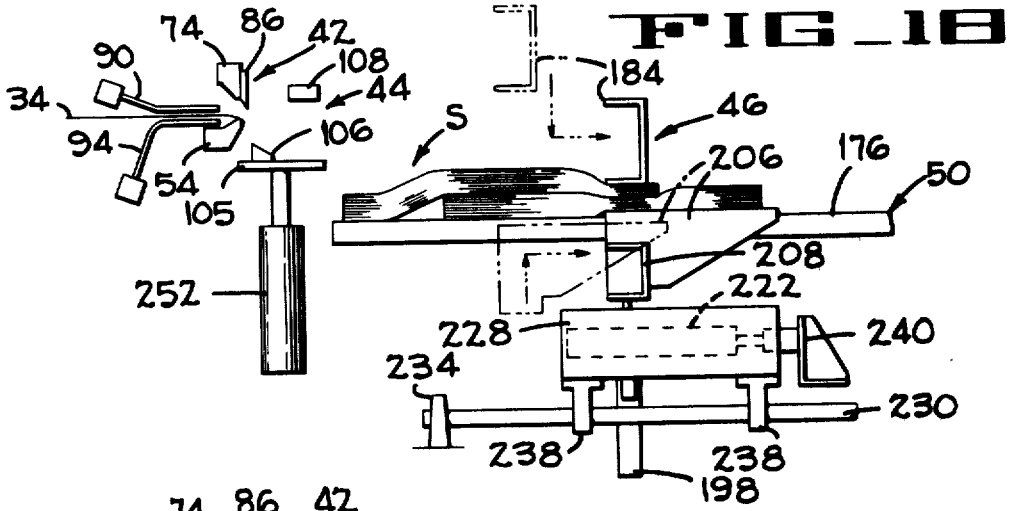
Figure 19:
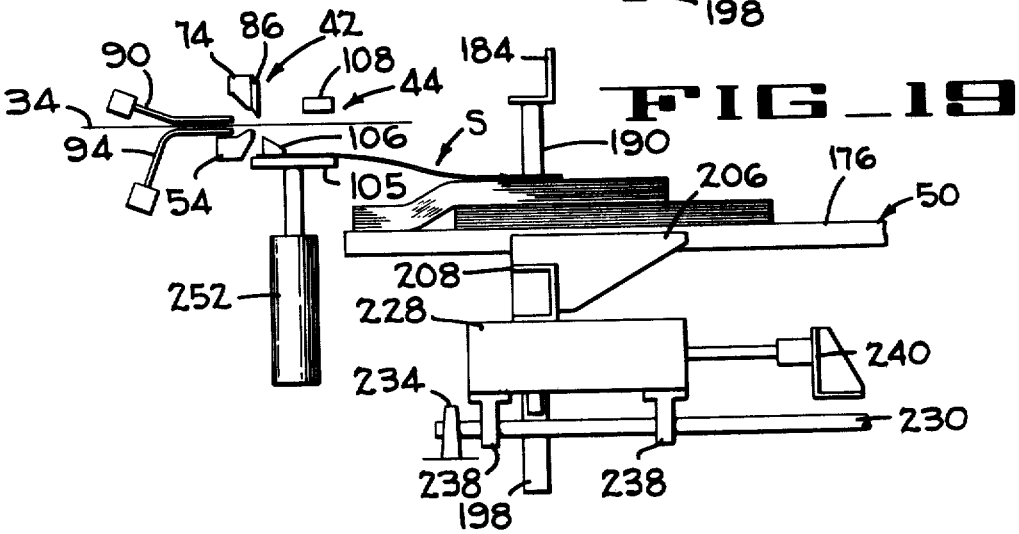

Accumulation of a subsequent stack overlying the first stack commences and it will be noted by reference to FIG. 17 that the bag stacks assume a shingled orientation. On completion of the subsequent stack, bag stack clamping and transporting means 46 are again operated as described above and as diagramatically illustrated in FIG. 18 to prepare the stacking table for the accumulation of another stack. FIG. 19 illustrates a third stack in the process of being accumulated.

Although the best mode contemplated for carrying out the present invention has been herein shown and described, it will be apparent that modification and variation may be made without departing from what is regarded to be the subject matter of the invention as defined in the appended claims.

What we claim is:

1. A bag stacking apparatus for accumulating web segments of equal length severed from an intermittently advanced web strip so that the respective edges of the segments assume substantially even-edged relationship, said stacking apparatus comprising a support located below the feed path of the web strip, and means including clamping means alternatively forceably engageable with said support and moveable above and below the feed path of the web strip for clamping the web strip and the resulting severed web segments to said support.

2. The stacking apparatus according to claim 1 further comprising an elongate table adjacent to said platform and extending in the direction of web advance, said table supporting the leading portion of the web segments accumulated on said support, means on said table and operable upon the accumulation of a selected number of web segments for clamping and conveying the selected number of segments along said table thereby clearing said platform for accumulation of another stack, and means operable before conveyance occurs for lowering the platform and thus effect removal of the clamping force exerted by said alternatively operable clamping means.

3. The stacking apparatus according to claim 2 wherein clamping and conveying of the selected number of web segments is effected by a beam extending transversely and above the surface of said table and an underlying platform elevatable above the surface of said table, means for lowering said beam and raising said platform to clamp the accumulated web segments, and means responsive to clamping of the accumulated web segments for translation thereof along said table.

4. The stacking apparatus of claim 2 further comprising means for raising or lowering said table relative to the feed path of the web to thereby accommodate web segment stacks of desired heights.

5. The stacking apparatus of claim 2 further comprising a frame structure incorporating said table and supporting said clamping and conveying means, means on said frame for moving said clamping means in opposite linear directions between predetermined limits, means displacing said clamping and conveying means at different locations relative to said table while allowing movement between such limits, and means for guiding and supporting said clamping and conveying means to follow a linear path.

6. A bag stacking apparatus for accumulating bags produced from an intermittently advanced web strip being severed and sealed at equally spaced longitudinal intervals to thereby produce bags of equal dimensions, said apparatus comprising means for severing and sealing the web during the period when its advance is interrupted, means for clamping and retaining successive web portions extending beyond said severing and sealing means, and means for conveying an accumulated group of web portions retained by said clamping means a distance less than the length of said web portions so that a subsequent group of accumulated web portions partially overlie the conveyed group of web portions.

7. A bag stacking apparatus driven by and synchronized with an intermittent motion bag machine operable to feed equal increments of thermoplastic web material between a sealing and severing mechanism being effective to sever and seal the web increment located therebetween during that portion of an operating cycle when web feeding is momentarily arrested, said apparatus comprising:

a stacking platform connected to a fluid actuator conditioned to bias said platform upwardly, reciprocating clamping bars operable to successively forceably engage said platform, said platform being located below the feed path and within the projected area of the web increments fed by said bag machine, means for reciprocating said clamping bars above and below the web feed path and maintaining at least one of said bars in engagement with said platform, said web increments, by the action of said clamping bars, being clamped to said platform until a selected number of the web increments are collected, and means for clamping and indexing the completed bag stack away from said platform.

8. A bag stacking apparatus operatively connected to an intermittent motion bag machine for producing thermoplastic bags comprising bag stacking means for accumulating bags at a stacking station until a predetermined number of bags are accumulated at said stacking station, and means for supporting, clamping and transporting a completed stack away from said stacking station so that a subsequent stack may be produced, said bag stack accumulating means comprising a platform located below the path in which the thermoplastic web is advanced by the bag machine, a linear actuator supporting and upwardly biasing said platform, reciprocating clamping bars alternatively moveable above and below the path of web advance and in forceable contact with platform, said reciprocation being phased so that at least one of said clamping bars is always in contact with the platform and the bags collected thereon, each of said clamping bars being reciprocated by connecting rods pivoted to cam operated rocking levers, said bag stack supporting, clamping and transporting means comprises a table formed with a plurality of transversely spaced elongate slots and being located adjacent said bag stack accumulating means so that a portion of the first and subsequent bags defining a stack is supported on said table, a transverse reciprocable beam overlying said table, linear actuators connected to each end of said beam and being effective to lower said beam in forceable contact with one or more bag stacks supported on said table, a platen in opposed relation to said beam and including a plurality of spaced plates moveable through the slots in said table, a linear actuator operable concurrently with said actuators effecting lowering of said beam to project said platen through said slots and thus clamp a completed stack above the surface of said table, and another linear actuator connected to said platen for translating the clamped bag stack longitudinally of said table.

* * * * *